US005263586A

United States Patent [19]

Keable

[11] Patent Number: 5,263,586

[45] Date of Patent: Nov. 23, 1993

[54] INTEGRATED MERCHANDISE DISPLAY AND RETURN PACKAGE

[75] Inventor: John B. Keable, Norcross, Ga.

[73] Assignee: Diamond Packaging Incorporated, Rochester, N.Y.

[21] Appl. No.: 808,182

[22] Filed: Dec. 13, 1991

[51] Int. Cl.[5] ..... B65D 73/00

[52] U.S. Cl. ..... 206/469; 206/461; 206/467; 206/395

[58] Field of Search ..... 206/395, 461, 467, 469, 206/491, 578; 229/921

[56] References Cited

U.S. PATENT DOCUMENTS

| | | | |
|---|---|---|---|
| 1,943,074 | 1/1934 | Heyman | 229/921 |
| 2,646,876 | 7/1953 | Sparks . | |
| 2,984,401 | 5/1961 | Herkender . | |
| 3,103,307 | 9/1963 | Shapiro . | |
| 3,278,015 | 10/1966 | Bernstein . | |
| 3,288,280 | 11/1966 | Bostrom | 206/461 |
| 3,302,861 | 2/1967 | Hiersteiner . | |
| 3,537,638 | 1/1969 | Hyman . | |
| 3,929,222 | 12/1975 | Smith et al. . | |
| 3,964,606 | 6/1976 | Hogg et al. | 206/395 |
| 3,985,232 | 10/1976 | Johnson | 206/461 |
| 4,140,218 | 2/1979 | Forte | 206/395 |
| 4,360,106 | 11/1982 | Irvine et al. . | |
| 4,413,730 | 11/1983 | Morse | 206/469 |
| 4,430,843 | 2/1984 | Favale . | |
| 4,735,356 | 4/1988 | Engel . | |
| 4,762,271 | 8/1988 | Lewyt . | |
| 4,949,845 | 8/1990 | Dixon . | |
| 5,020,669 | 6/1991 | Nakagoshi | 206/461 |

FOREIGN PATENT DOCUMENTS

| | | | |
|---|---|---|---|
| 1223262 | 2/1971 | United Kingdom | 206/461 |

*Primary Examiner*—David T. Fidei
*Attorney, Agent, or Firm*—Nixon, Hargrave, Devans & Doyle

[57] ABSTRACT

An integrated merchandise display and return package is disclosed that allows merchandise, such as a roll of photographic film, to be packaged in a container which can have a protective barrier and displayed in a retail outlet. The exposed film may be returned to a photoprocessor in a return carton that is removably attached to the container.

12 Claims, 4 Drawing Sheets

FIG. 3
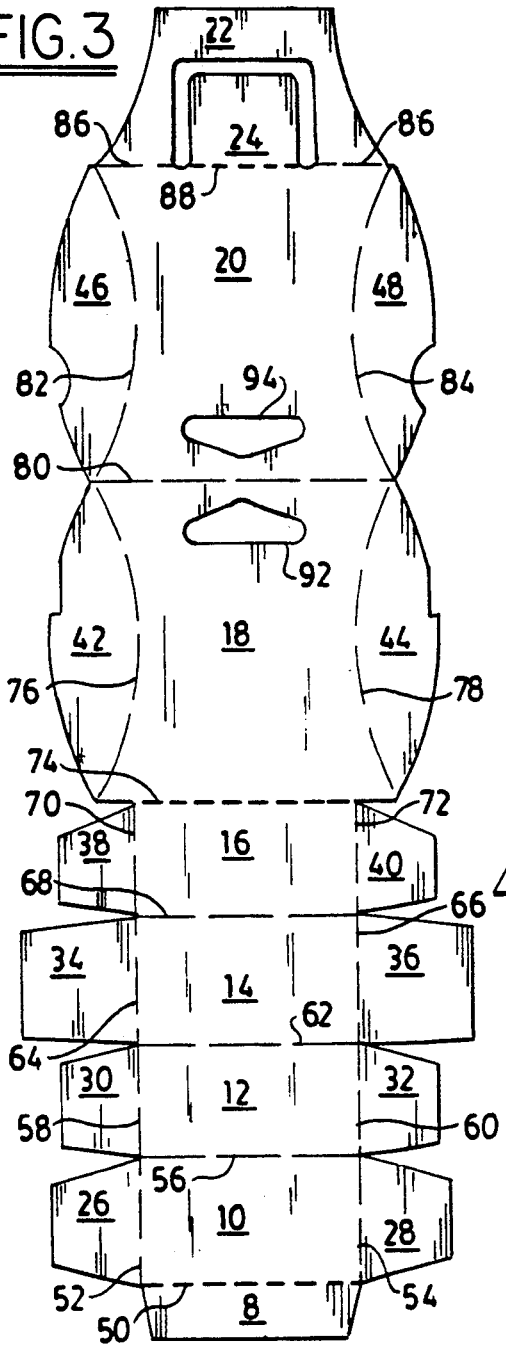
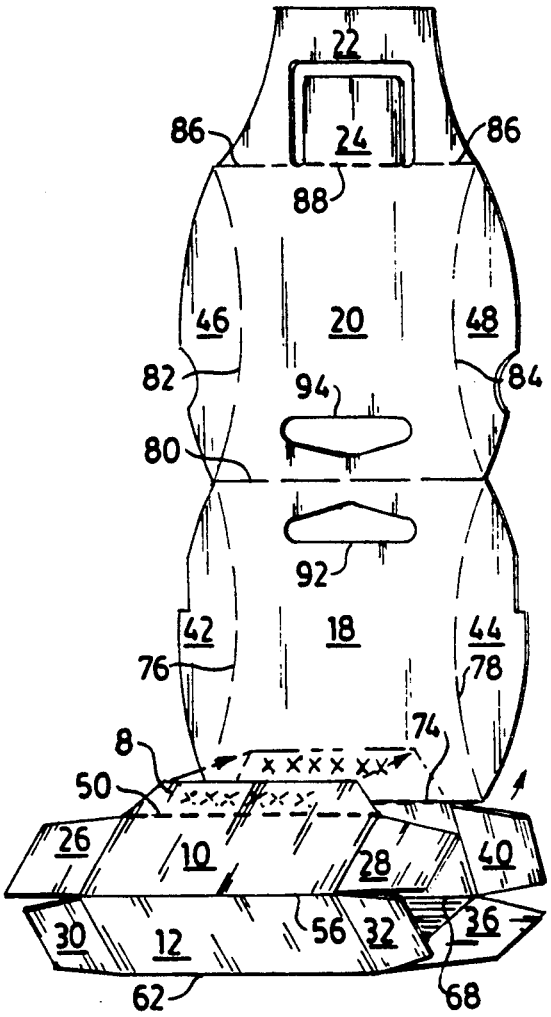
FIG. 4
FIG. 4A
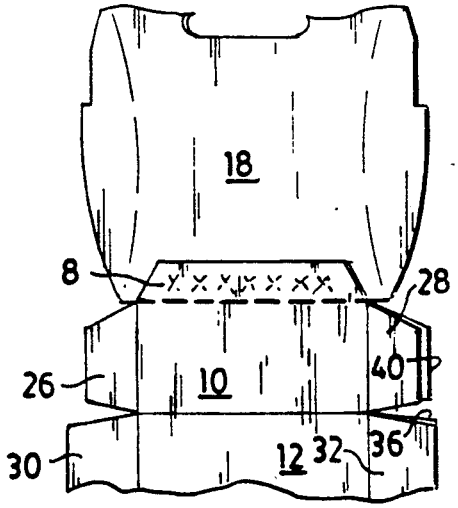

INTEGRATED MERCHANDISE DISPLAY AND RETURN PACKAGE

FIELD OF THE INVENTION

This invention relates to a integrated display and return package for photographic film.

BACKGROUND OF THE INVENTION

Typically, retail merchandise packaging includes only a display container for selling the merchandise. However, it is sometimes advantageous to market merchandise with both a return container adapted for retail display of the merchandise and a container adapted to store or transport the merchandise after sale.

Conventional photographic film packaging comprises a box or carton which contains a roll of film in a plastic container. To access the roll of film, it must be removed from the container with the carton being discarded. Following exposure, the film is stored and returned to a photoprocessor in the plastic container. This form of photographic film packaging suffers from several disadvantages. The use of disposable plastic containers presents environmental problems that are not present with other forms of packaging. Additionally, the plastic containers are more expensive to produce, are more expensive to dispose of, and are not readily recyclable. The plastic containers, as currently marketed, also provide no retail sales tie to the film manufacturer or film processor and, therefore, do not enhance the future sale of film or the services of the processor.

There have been attempts to produce a combination mailer and display device for photographic film and other merchandise.

U.S. Pat. No. 3,278,015 to Bernstein relates to a combination envelope and display device for photographic film which promotes film sales and the services of a film processing company. This package includes an envelope having a removable panel on which a box of film is mounted with a transparent plastic shell. This panel may be removed from the envelope so that the exposed film can be placed in the envelope and mailed to a processing company.

U.S. Pat. No. 3,537,638 to Hyman discloses an envelope for mailing film which is mounted on a card to which new film is attached for marketing. Once the film is exposed, the envelope can be removed from the card and the film placed in the envelope for mailing to a processor.

U.S. Pat. No. 2,646,876 to Sparks discloses a mailable display package, including a paper-board card which can be folded into a closeable box and a foldable core placed inside the box to keep the material being mailed from shifting.

U.S. Pat. No. 4,430,843 to Savale discloses a mailing and display package prepared from a paper-board card with a transparent film window through which the product being merchandised can be viewed. The entire Savale package, merchandise and all, may be mailed.

Despite numerous attempts at producing a combination display and storage, mailing, or return package, there continues to be a need for integrated packages exhibiting ease of manufacture, low cost, and the ability to enhance retail sales of the merchandise as well as the services of a processor, such as a photographic film processor.

SUMMARY OF THE INVENTION

The present invention provides an integrated merchandise display and return package which includes a container for holding merchandise and a display card which is removably attached to the merchandise container. The display card is constructed to serve also as a return carton for the merchandise. For the purposes of this invention a "return carton" may be a package suitable for mailing or for drop-off or both. The integrated package of the present invention may be useful for a wide variety of merchandise; however, it has particular utility in conjunction with photographic film. For example, an exposed roll of film can be placed in the display card/return carton, the consumer information required for processing written directly on the display card/return carton, and the display card/return carton returned to the photoprocessor. The photographic film package, in addition to having conventional marketing information printed thereon, may also be adapted to provide a marketing connection with a particular film processor.

The integrated merchandise display and return package of the present invention is inexpensive to produce, dispenses with the need to use a separate plastic container to store the exposed roll of film, allows a one piece display and return carton to be attached directly to the original film container, allows a marketing connection between the merchandise and a potential merchandise processor, and produces less waste and more recycling opportunities for the packaging.

BRIEF DESCRIPTION OF THE DRAWINGS

FIG. 3 is a plan view of the inner surface of the package blank from which the package of FIG. 1 is formed.

FIG. 4 is a perspective view of the blank of FIG. 3 illustrating the container portion in a partially folded configuration.

FIG. 4A is a partial, plan view of the blank of FIG. 3 in a partially folded configuration illustrating how the display container is adhesively secured to the return carton.

DETAILED DESCRIPTION OF THE DRAWINGS

The package of the present invention may be used for displaying a variety of merchandise. The merchandise display and return package of the present invention is especially useful for and preferably used to package rolls of photographic film.

Figure 1:
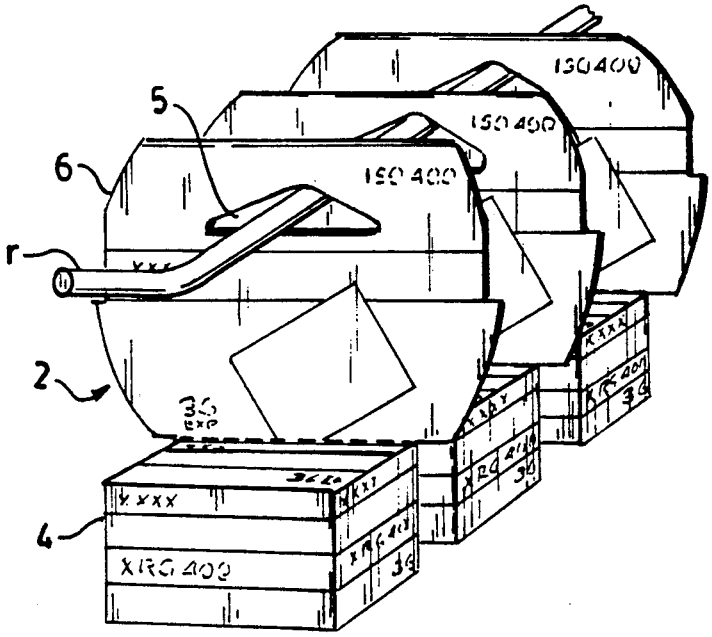
FIG. 1 is a perspective view of the package of the present invention on a display rod.
Figure 2:
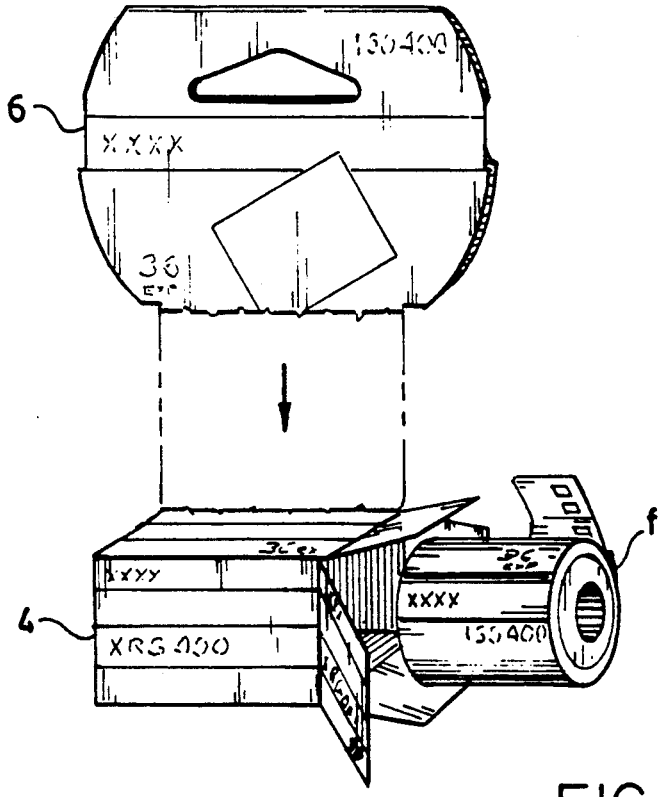
FIG. 2 is an exploded, perspective view of the package of the present invention showing a container that has been removed from the return carton and opened to remove a roll of photographic film.

FIG. 1 is a perspective view of the package of the present invention displayed on a display rod. Integrated display and return package 2 includes container 4 for holding an unexposed roll of film and flat return carton 6 that is removably attached to container 4. For the purpose of this invention, a "return carton" is a carton suitable for mailing, drop-off, or both. Integrated package 2 is displayed on rod r, as commonly found in retail outlets, through hole 5, which is included in return carton 6. FIG. 2 is an exploded, perspective view of the package of the present invention showing a container that has been removed from the return carton and opened to remove a roll of photographic film. Referring to FIG. 2, upon purchase, the consumer detaches container 4 from return carton 6 and removes film roll f from container 4.

FIG. 3 is a plan view of the inner surface of the package blank from which the package of FIG. 1 is formed. The blank illustrated in FIG. 3 is cut and folded to hold together permanently connected parts of the package and perforated to connect removably attached parts of the package.

Container 4 is formed of a plurality of substantially rectangular walls including rear wall 10, bottom wall 12, front wall 14, and top wall 16. Bottom wall 12 and top wall 16 are joined along fold lines 62 and 68, respectively, to front wall 14. Rear wall 10 is connected to bottom wall 12 along fold line 56. End flaps 26 and 28 are connected to rear wall 10 by fold lines 52 and 54, respectively. End flaps 30 and 32 are connected to bottom wall 12 by fold lines 58 and 60, respectively. End flaps 34 and 36 are connected to front wall 14 by fold lines 64 and 66, respectively. End flaps 38 and 40 are connected to top wall 16 by fold lines 70 and 72, respectively. Closure flap 8 is removably attached to rear wall 10 by perforated line 50. Optionally, container 4 can be provided with a barrier to protect the merchandise from moisture, etc. The barrier may be a layer which is laminated or coated on the inner surface of container 4 or container 4 may be impregnated with a moisture resistant barrier material. Suitable barrier materials include metal foil, polyethylene, a combination or laminate of polyethylene and foil, or a paper-polyethylene-foil-polyethylene laminate.

Return carton 6 includes front and back panels 18 and 20. Front panel 18 is removably attached to top wall 16 by perforated line 74. Back panel 20 is connected to front panel 18 by fold line 80. Elliptical end flaps 42 and 44 are connected to front panel 18 by arcuately-shaped fold lines 76 and 78, respectively, and elliptical end flaps 46 and 48 are connected to rear panel 20 by arcuately-shaped fold lines 82 and 84, respectively. Aligned holes 92 and 94 are put in front panel 18 and rear panel 20, respectively, to hang integrated package 2 on display rod r, as illustrated by FIG. 1.

Closure flap 22 is connected to rear panel 20 by fold line 86. In a preferred embodiment of the package of the present invention, removable tab 24 is cut out of closure flap 22 and removably attached to rear panel 20 by perforated line 88. Removable tab 24 may serve, for example, as a customer receipt upon return of film to the photoprocessor or as promotional material (e.g., a coupon for retail savings or a contest entry form).

Figure 4B:
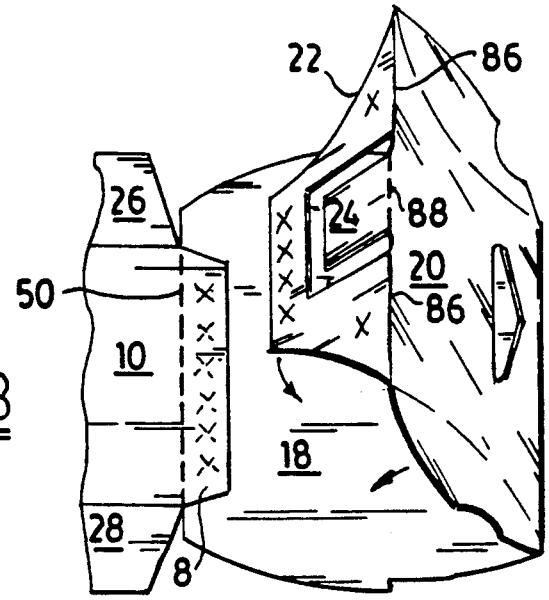
FIG. 4B is a partial perspective view of the blank of FIG. 3 showing the return carton in a partially folded configuration.
Figure 4C:
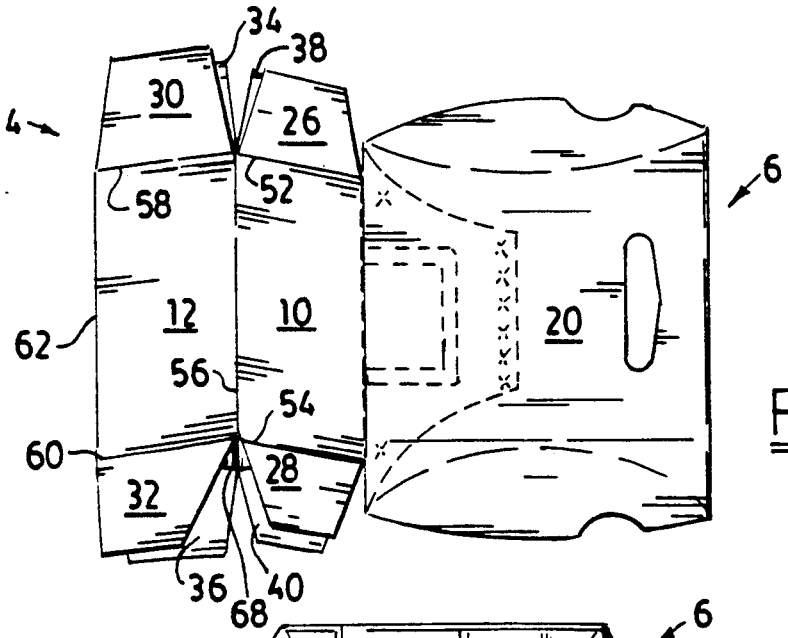
FIG. 4C is a perspective view of the blank of FIG. 3 folded flat and illustrating the return carton adhesively secured.

FIGS. 4 through 4C comprise a series of perspective and plan views of the blank of FIG. 3 and illustrate a sequence of steps leading to the formation of the integrated package of FIG. 1. FIG. 4 is a perspective view of the blank of FIG. 3 illustrating the container portion in a partially folded configuration. FIG. 4A is a partial, plan view of the blank of FIG. 3 in a partially folded configuration illustrating how the display container is adhesively secured to the return carton. FIG. 4B is a partial perspective view of the blank of FIG. 3 showing the return carton in a partially folded configuration. FIG. 4C is a perspective view of the blank of FIG. 3 folded flat and illustrating the return carton adhesively secured.

The outer surface of the package blank illustrated by FIG. 3 is typically printed before it is cut into the shape illustrated by FIG. 3. As shown in FIG. 4, glue or some other adhesive is applied either to the bottom of the inner surface of panel 18 or, preferably, the inner surface of closure flap 8. The adhesive is indicated on FIG. 4 by a series of Xs. Walls 10, 12, 14, and 16 are then formed into a open-ended display container by folding at fold-lines 50, 56, 62 and 68, respectively. Pressure is applied to closure flap 8 to permanently adhere it to the inner surface of front panel 18. Referring to FIG. 4A, display container 4 is folded to a substantially flat state so that the inner surfaces of rear wall 10 and bottom wall 12 lay respectively against the inner surfaces of top wall 16 and front wall 14.

In FIG. 4B, glue or some other adhesive is applied to the outer surface of closure flap 22. No adhesive is applied to removable tab 24. Closure flap 22 and removable tab 24 are folded inwardly toward the inner surface of rear panel 20 along fold-line 86 and perforation line 88. Pressure is applied to closure flap 22 to permanently adhere closure flap 22 to the lower inner surface of front panel 18 thus forming return carton 6 as shown by FIG. 4C. FIG. 4C also illustrates the configuration of the integrated display and return package of the present invention that is preferably shipped from the package manufacturer to the merchandise packager. As shown by FIG. 4C, package 2 is substantially flat. Front and rear panels 18 and 20 of return carton 6 are separable but unseparated. Likewise, the inner surface of rear wall 10 and bottom wall 12 lay substantially flat against the inner surfaces of top wall 16 and front wall 14, respectively. Integrated package 2 is preferably shipped with end flaps 26, 28, 30, 32, 34, 36, 38, 40 and end panels 42, 44, 46, 48 all open as shown by FIG. 4C.

Figure 5:
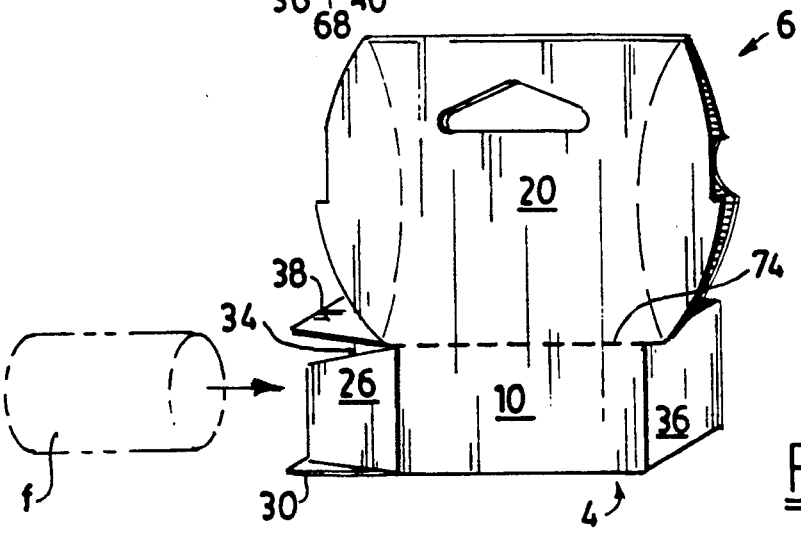
FIG. 5 is a perspective view of the blank of FIG. 3 in a partially folded configuration ready for the insertion of products.

FIG. 5 is a perspective view of the blank of FIG. 3 in a partially folded configuration ready for the insertion of products. To prepare integrated package 2 for the insertion of merchandise, merchandise container 4 is erected by separating rear wall 10 and bottom wall 12 from top wall 16 and from wall 14 by making folds along fold-lines 56, 68, and 74. Next, merchandise container 4 is closed at one end by closing end flaps 40, 32, 28 and 36 by making folds along fold lines 72, 60, 54 and 66, respectively. Glue or some other adhesive is preferably applied to the inner surface of end flap 36 to relatively permanently secure the inner surface of end flap 36 to the outer surface of end flap 28 and close one end of merchandise container 4.

Merchandise, such as photographic film roll f is then inserted into merchandise container 4 through the remaining open end of container 4. Container 4 is then closed to package film f by closing end flaps 30, 38, 26 and 34 by making folds along fold lines 58, 70, 52 and 64, respectively. Glue or some other adhesive may be applied to the inner surface of end flap 34 (or the outer surface of end flap 26) before folding along fold line 64 to relatively permanently secure the inner surface of end flap 34 to the outer surface of end flap 26 and close merchandise container 4.

Upon insertion of film f into and closure of merchandise container 4, integrated package 2 may be displayed as illustrated in FIG. 1, for example.

FIGS. 6–12 comprise a sequence of figures illustrating the use of a preferred embodiment of the package of the present invention.

Figure 7:
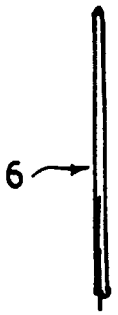
FIG. 7 is a side view of the detached return carton of FIG. 6.
Figure 6:
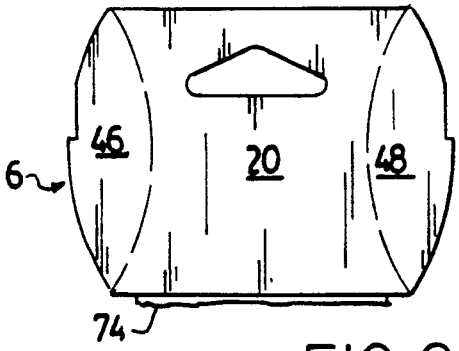
FIG. 6 is a front view illustrating the return carton of the present invention removed from the container of the present invention.
Figure 9:
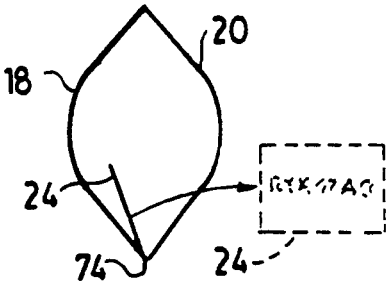
FIG. 9 is a side view of the return carton of FIG. 8.
Figure 8:
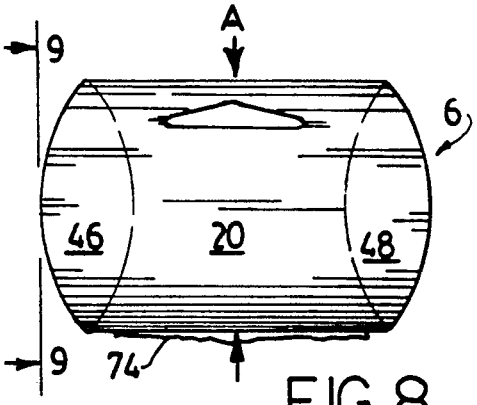
FIG. 8 is a perspective view of the return carton of FIG. 6 illustrating the formation of a chamber by separating the panels of the return carton.

FIG. 6 is a front view illustrating the return carton detached from the container of the present invention. Return carton 6 is first detached from display container 4 by tearing along perforation lines 50 and 74, shown in FIG. 3. FIG. 7 is a side view of the detached return carton of FIG. 6. FIG. 8 is a perspective view of the return carton of FIG. 6 illustrating the formation of a chamber by separating the panels of the return carton. In FIG. 8, separable panels 18 and 20 are separated by the application of inward pressure at the points indicated by arrows A to form a chamber with an opening through which merchandise can be inserted into the chamber. FIG. 9 is a side view of the return carton of FIG. 8. Removable tab 24 can be detached from return carton 6 by tearing along perforation line 88, as shown by FIG. 9. Tab 24 may be used as a customer receipt or as other promotional material.

Figure 10:
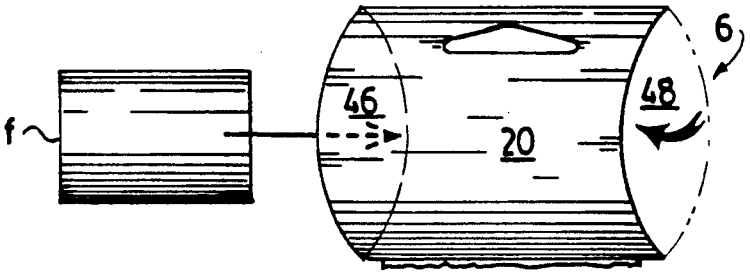
FIG. 10 is a perspective view of the return carton of FIG. 8 with one end of the return carton closed and ready for insertion of product.
Figure 12:
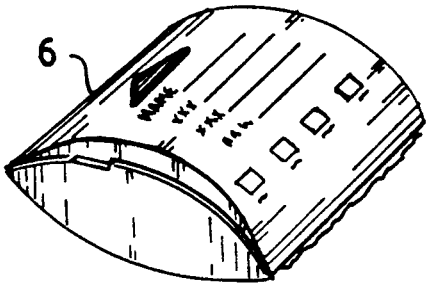
FIG. 12 is a side perspective view of the return carton of FIG. 8 with product inserted and both ends closed.
Figure 11:
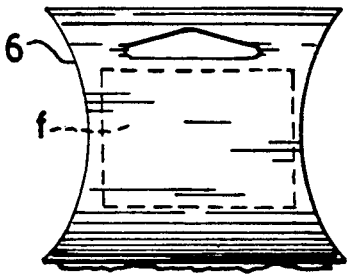
FIG. 11 is a front view of the return carton of FIG. 8 with product inserted and both ends closed.

FIG. 10 is a perspective view of the return carton of FIG. 8 with one end of the return carton closed and ready for insertion of product. FIG. 11 is a front perspective view of the return carton of FIG. 8 with product inserted and both ends closed. FIG. 12 is a perspective view of the return carton of FIG. 8 with product inserted and both ends closed. In FIG. 10, exposed photographic film f is inserted into return carton 6. Next, end flaps 44, 48, 42 and 46 are closed by making folds along fold-lines 78, 84, 76 and 82, respectively, to form the closed return container illustrated by FIGS. 11 and 12. Preferably end flaps 44, 48, 42, 46 are substantially elliptical and connected to panels 18, 20 by arcuately-shaped fold-lines.

In this preferred embodiment, using separate panels that essentially bow outwardly to form a chamber and substantially elliptical end flaps, return carton 6 may be closed after the insertion of film roll f without the use of any glue or adhesive to cause carton 6 to remain relatively permanently closed. Film roll f may then be mailed, dropped off, or otherwise returned to a photoprocessor in return carton 6 without the use of additional packaging.

The integrated merchandise display and return package of the present invention is inexpensive to produce, dispenses with the need to use a separate plastic container to store the exposed roll of film, allows a one piece display and return carton to be attached directly to the original film container, allows a marketing connection between the merchandise and a potential merchandise processor, and produces less waste and more recycling opportunities for the packaging.

Although the invention has been described in detail for the purpose of illustration, it is understood that such detail is solely for that purpose, and variations can be made therein by those skilled in the art without departing from the spirit and scope of the invention which is defined by the following claims.

What is claimed is:

1. An integrated merchandise display and return package comprising:

a container for holding an article of merchandise;

a return carton removeably attached to said container including first and second separable substantially-aligned panels each having a top edge and a bottom edge, wherein said separable panels are joined at their top edges and their bottom edges and may pulled away from each other to form a chamber having a substantially elliptical cross-section and two closeable end flaps extending between the top and bottom edges of said first and second separable panels, wherein said first and second separable panels may be pulled away from each other to form a chamber with two open sides through which merchandise can be inserted into the chamber and said end flaps may be folded over to enclose the merchandise within the chamber; and first and second closure flaps wherein said first closure flap is attached to said container and has a fold-line substantially aligned with the bottom edge of the first separable panel of said return carton and is affixed to the first separable panel and said second closure flap is attached to said second separable panel of said return carton at a fold-line aligned with the bottom edge of said second panel and is secured to the first closure flap within the chamber defined by the first and second panels.

2. An integrated display and return package according to claim 1, wherein the fold lines for the first and second closure flaps are perforated to facilitate separation of said container from said return carton.

3. An integrated merchandise display and return package comprising:

a container for holding an article of merchandise including a front wall, a rear wall, a top wall, and a bottom wall with the top wall and the bottom wall being opposed and each being joined to the front and rear walls by separate substantially parallel fold lines, wherein each of the walls has at least one end flap attached by a fold line substantially perpendicular to the fold lines joining the walls and a return carton removeably attached to said container including first and second separable substantially-aligned panels each having a top edge and a bottom edge and two closeable end flaps extending between the top and bottom edges of said first and second separable panels, wherein said first and second separable panels may be pulled away from each other to form a chamber with two open sides through which merchandise can be inserted into the chamber and said end flaps may be folded over to enclose the merchandise within the chamber.

4. An integrated display and return package according to claim 3, wherein the top, bottom, front and rear wall together with their end flaps are positioned with their inner surfaces being adapted to define a merchandise chamber.

5. An integrated display and return package according to claim 4, wherein the merchandise chamber is enclosed by the top, bottom, front, and back walls together with their end flaps with the merchandise chamber containing an article of merchandise.

6. An integrated display and return package according to claim 5, wherein the merchandise is photographic film.

7. An integrated display and return package according to claim 3, wherein said first and second separable panels each have a top edge and a bottom edge with said panels being joined at their tops and at their bottoms and may be pulled away from each other to form the chamber with a substantially elliptical cross-section.

8. An integrated display and return package according to claim 7, wherein said package further comprises:

a perforated line substantially aligned with the bottom edge to facilitate separation of said container from said return carton.

9. An integrated display and return package according to claim 8, wherein the fold line between the top and rear panels is substantially aligned with the bottom edges of the panels and said package further comprises:

a perforation means contiguous with the fold line between the top and rear panels and the bottom edges to facilitate separation of said container from said return carton.

10. An integrated display and return package according to claim 4, wherein said package is folded to a substantially flat state so that the inner surfaces of the container's rear wall and bottom wall lay respectively against the inner surfaces of said top wall and said front wall, and the separable panels of said return carton are unseparated.

11. An integrated merchandise display and return package, comprising:

a container for holding an article of merchandise comprising a front wall, a rear wall, a top wall, and a bottom wall with the top wall and the bottom wall being opposed and each being joined to the front and rear walls by separate substantially parallel fold-lines, wherein each of the walls has at least one end flap attached by a fold-line substantially perpendicular to the fold-lines joining the walls, and wherein the top, bottom, front, and rear wall together with their end flaps are positioned with their inner surfaces being adapted to define a merchandise chamber containing an article of merchandise;

a return carton removeably attached to said container formed from first and second separable substantially-aligned panels which may be pulled away from each other to form a chamber with an opening through which merchandise can be inserted into the chamber, wherein each panel includes opposed, arcuately-shaped side edges extending between the top and bottom edges and arcuately-shaped fold-lines extending between where each side edge intersects the top and bottom edges, wherein each pair of the side edges and the fold-lines defines a pair of substantially elliptical end flaps which can be folded over, after separably pulling the first and second end panels apart, to enclose the chamber;

a first closure flap attached to said container at a perforated line substantially aligned with the bottom edge of the first separable panel and bonded to the first separable panel; and a second closure flap attached to said second separable panel at a fold-line substantially aligned with the bottom edge of said second panel, wherein the second closure flap is bonded to the first closure flap within the chamber defined by the first and second panels.

12. An integrated merchandise display and return package according to claim 11, wherein said container further comprises as the article of merchandise a photographic film.

* * * * *